US008628027B2

(12) United States Patent
Kah, Jr. et al.

(10) Patent No.: US 8,628,027 B2
(45) Date of Patent: Jan. 14, 2014

(54) OSCILLATING NOZZLE SPRINKLER ASSEMBLY WITH MATCHED PRECIPITATION AND ADJUSTABLE ARC OF COVERAGE

(76) Inventors: Carl L. C. Kah, Jr., North Palm Beach, FL (US); Carl L. C. Kah, III, North Palm Beach, FL (US); Weiming Feng, West North Palm Beach, FL (US)

( * ) Notice: Subject to any disclaimer, the term of this patent is extended or adjusted under 35 U.S.C. 154(b) by 640 days.

(21) Appl. No.: 12/340,411

(22) Filed: Dec. 19, 2008

(65) Prior Publication Data

US 2009/0173804 A1 Jul. 9, 2009

Related U.S. Application Data

(60) Provisional application No. 61/015,567, filed on Dec. 20, 2007.

(51) Int. Cl.
*B05B 3/16* (2006.01)

(52) U.S. Cl.
USPC ..... 239/242; 239/206

(58) Field of Classification Search
USPC ..... 239/225.1, 569, 571, 581.1, 200–206, 239/240, 242, 230
See application file for complete search history.

(56) References Cited

U.S. PATENT DOCUMENTS

| | | | | |
|---|---|---|---|---|
| 4,895,305 | A | 1/1990 | Powell | |
| 6,085,995 | A | 7/2000 | Kah, Jr. et al. | |
| 6,241,158 | B1 * | 6/2001 | Clark et al. | 239/1 |
| 6,732,952 | B2 | 5/2004 | Kah, Jr. | |
| 7,143,962 | B2 | 12/2006 | Kah, Jr. | |
| 7,226,003 | B2 | 6/2007 | Kah, Jr. et al. | |

OTHER PUBLICATIONS

International Search Report dated Feb. 17, 2009 relating to International Patent Application No. PCT/US2008/013891.

* cited by examiner

*Primary Examiner* — Davis Hwu
(74) *Attorney, Agent, or Firm* — Ostrolenk Faber LLP

(57) ABSTRACT

An oscillating nozzle sprinkler with adjustable arc of coverage in accordance with an embodiment of the present application includes a nozzle, a nozzle drive mechanism operable to drive the nozzle through a set arc of coverage, an arc set mechanism coupled to the nozzle drive mechanism and operable to adjust the set arc of coverage for the nozzle drive mechanism; and a flow control mechanism operable to vary a nozzle flow area through which water flows through the nozzle and out of the sprinkler, the flow control mechanism coupled to the arc set mechanism such that the flow area is adjusted with the arc of coverage.

16 Claims, 9 Drawing Sheets

Section 1-1

OSCILLATING NOZZLE SPRINKLER ASSEMBLY WITH MATCHED PRECIPITATION AND ADJUSTABLE ARC OF COVERAGE

CROSS-REFERENCE TO RELATED APPLICATIONS

The present application claims benefit of and priority to U.S. Provisional Patent Application Ser. No. 61/015,567 entitled MATCHED PRECIPITATION ADJUSTABLE COVERAGE OSCILLATING NOZZLE SPRINKLER filed Dec. 20, 2007, the entire contents of which are hereby incorporated by reference herein.

BACKGROUND

1. Field of the Disclosure

The present disclosure relates to an oscillating nozzle sprinkler in which match precipitation adjustment is provided. More specifically, the present application relates to an oscillating nozzle sprinkler with adjustable arc of coverage setting including integrated automatic flow rate adjustment such that the flow rate changes with the arc of coverage to automatically provide a matched precipitation rate without the need to change nozzles.

2. Related Art

U.S. Pat. Nos. 4,867,378 and 4,901,924 disclose oscillating sprinklers with adjustable arcs of coverage and an indicator on the top of the nozzle that displays the selected arc angle. U.S. Pat. No. 5,417,370 discloses a reversing gear drive with a settable arc of oscillation. These references illustrate several drive mechanisms for oscillating sprinklers in which the arc of coverage is easily adjustable, and which provide an indication of the selected arc angle on the top of the nozzle housing. Other types of drive mechanisms such as ball drives and reversing turbine gear drives can also be used in such sprinklers.

U.S. Pat. No. 5,098,021 relates to an oscillating nozzle sprinkler with integrated adjustability of both arc of coverage and flow. In this patent, the selected flow rate (or the corresponding precipitation rate) is displayed on the top of the nozzle separately from the selected arc setting. This patent also discloses a nozzle configuration with an adjustable throat plug for changing the flow rate through the nozzle and various configurations for providing different water distribution patterns U.S. Pat. No. 5,086,977 relates to an oscillating water driven sprinkler having a nozzle in which the stream elevation angle or spray range is adjustable from the top surface of the nozzle using a screw mechanism.

U.S. Pat. No. 6,237,862 relates to a nozzle configuration in which the nozzle tube is surrounded by and attached to a flexible thin diaphragm. The shape of the diaphragm allows the nozzle tube to be effectively hinged so that deflecting the nozzle tube establishes a desired sprinkler stream exit angle.

The above-mentioned U.S. Pat. Nos. 4,867,378, 4,901,924, 5,417,370, 5,098,021, and 6,237,862 provide general, technical background, and further physical and mechanical background for the features and improvements of the present application and are hereby incorporated by reference herein as if fully disclosed.

None of these patents, however, nor any other sprinklers known to applicant, provide the capability for automatic adjustment of the flow to maintain a preset precipitation rate as the spray range and/or arc of coverage is adjusted. None of these references disclose maintaining a constant precipitation rate if a pre-selected spray range, or arc of coverage is changed in the field, or even recognize how the precipitation rate is affected by such changes without performing a laborious calculation, which is rarely, if ever, done in practice This can be a significant inconvenience in some instances. For example, in arranging uniform coverage of the area under irrigation, sprinklers are often arranged in a triangular pattern, and adjusted for maximum range. Sometimes, however, best coverage can be obtained with a square, or in-line pattern, or with combinations of sprinklers grouped in different patterns. In addition, the installer may need to adjust the ranges and arc angles of some or all of the sprinklers at the time of installation. Since it is important that the precipitation rates of individual sprinklers or groups of sprinklers be matched for uniform precipitation and the flow for a given precipitation rate varies with the spray range and arc angle, it has been practically impossible to preset the flow for a desired precipitation rate. It has thus been customary to install different nozzles at different locations in complex layouts in order to achieve reasonably uniform precipitation.

A need clearly exists for a sprinkler in which the arc angle, spray range, and precipitation rate are adjustable, and in which a desired precipitation rate can be set and maintained by automatic changes in the flow rate as adjustments of the arc angle and spray range are made by the user.

U.S. Pat. No. 6,732,952 discloses an oscillating nozzle sprinkler with integrated adjustable arc, precipitation rate, flow rate and range of coverage adjustment. However, this reference also fails to disclose a sprinkler assembly in which flow control is provided automatically as a function of arc of coverage adjustment to provide a constant precipitation rate Accordingly, it would be desirable to provide an oscillating nozzle assembly that provides for an adjustable arc of coverage and avoids the problems discussed above.

SUMMARY

It is an object of the present disclosure to provide an oscillating nozzle sprinkler assembly with a settable arc of coverage that provides variable flow for matched precipitation as the arc of coverage is varied that is easy and reliable to manufacture.

An oscillating nozzle sprinkler with adjustable arc of coverage in accordance with an embodiment of the present application includes a nozzle, a nozzle drive mechanism operable to drive the nozzle through a set arc of coverage, an arc set mechanism coupled to the nozzle drive mechanism and operable to adjust the set arc of coverage for the nozzle drive mechanism; and a flow control mechanism operable to vary a nozzle flow area through which water flows through the nozzle and out of the sprinkler, the flow control mechanism coupled to the arc set mechanism such that the flow area is adjusted with the arc of coverage.

An oscillating sprinkler with adjustable arc of coverage in accordance with an embodiment of the present application includes a nozzle, a nozzle drive mechanism operable to drive the nozzle through a set arc of coverage, an arc set mechanism coupled to the nozzle drive mechanism and operable to adjust the set arc of coverage for the nozzle drive mechanism, a flow control mechanism operable to vary a nozzle flow area through which water flows through the nozzle and out of the sprinkler, the flow control mechanism coupled to the arc set mechanism such that the flow area is adjusted with the arc of coverage; and a throttling valve positioned upstream from the flow control mechanism and operable to rotate continuously from an open position in which water flow to the nozzle is uninterrupted and a closed position in which water flow to the nozzle is stopped.

An oscillating sprinkler with adjustable arc of coverage in accordance with an embodiment of the present application includes a nozzle, a nozzle drive mechanism operable to drive the nozzle through a set arc of coverage, an arc set mechanism coupled to the nozzle drive mechanism and operable to adjust the set arc of coverage for the nozzle drive mechanism, a flow control mechanism operable to vary a nozzle flow area through which water flows through the nozzle and out of the sprinkler, the flow control mechanism coupled to the arc set mechanism such that the flow area is adjusted with the arc of coverage, and a spray range setting mechanism operable to adjust a range of the stream of water exiting the sprinkler, wherein the spray range mechanism is coupled to the flow control mechanism such that the flow area is varied with the range of the stream of water.

An oscillating sprinkler with adjustable arc of coverage in accordance with an embodiment of the present application includes a nozzle, a nozzle drive mechanism operable to drive the nozzle through a set arc of coverage, an arc set mechanism coupled to the nozzle drive mechanism and operable to adjust the set arc of coverage for the nozzle drive mechanism; and , a flow control mechanism operable to vary a nozzle flow area through which water flows through the nozzle and out of the sprinkler, the flow control mechanism coupled to the arc set mechanism such that the flow area is adjusted with the arc of coverage wherein the nozzle is selected based on a size of an opening in the nozzle through which water passes to exit the sprinkler.

Other features and advantages of the present invention will become apparent from the following description of the invention which refers to the accompanying drawings.

DETAILED DESCRIPTION OF THE EMBODIMENTS

Figure 1:
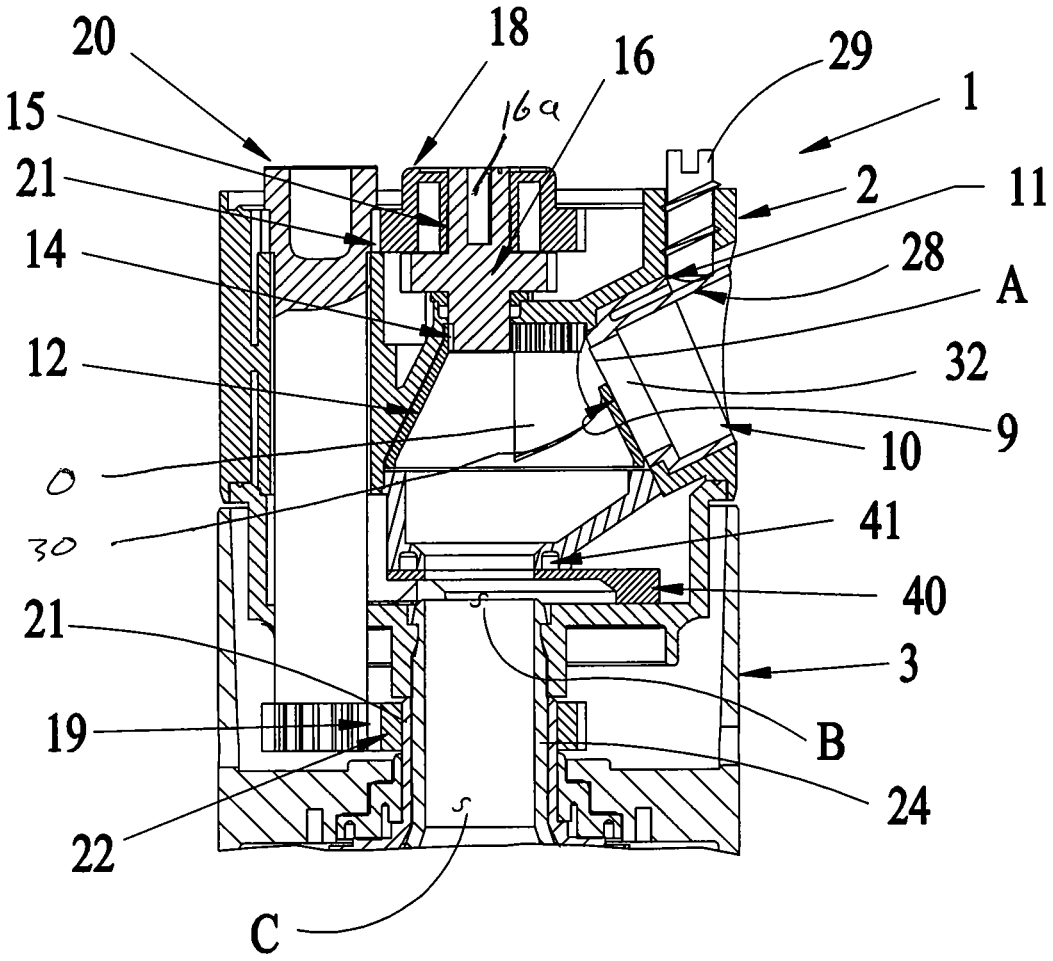
FIG. 1 illustrates a cross-section of an oscillating nozzle sprinkler assembly with adjustable arc of oscillation and integrated adjustable nozzle exit flow area in accordance with an embodiment of the present application.
Figure 2:
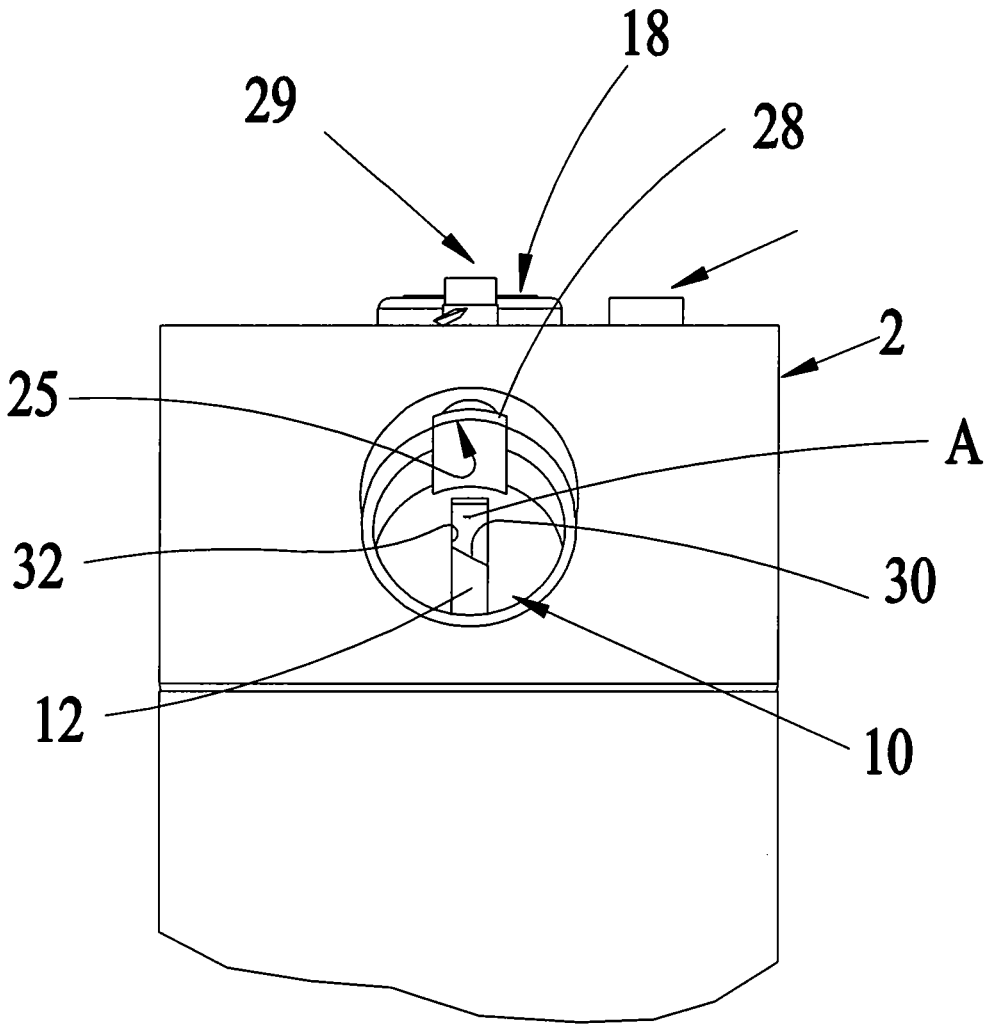
FIG. 2 shows a perspective view of the sprinkler assembly of FIG. 1 looking into the nozzle.

In accordance with one embodiment of the present disclosure, an oscillating nozzle sprinkler assembly 1 (see FIG. 1, for example) including an oscillating nozzle assembly, or nozzle housing 2 is provided to allow for a settable arc of coverage and an automatically adjustable flow rate. The flow area for water to flow through the nozzle automatically adjusts to correspond to a change in the set arc of coverage (oscillation) of the sprinkler. In one preferred embodiment, this is accomplished by providing a tapered opening in an approximately 25 degree cone shaped flow valve element 12. The flow valve element 12 preferably rotates to increase and decrease the flow area A through which water reaches a vertical slot 32 in the nozzle 10. That is, as the flow valve element 12 rotates, a larger or smaller portion of the tapered opening O is aligned with the slot 32 in the nozzle 10 such that the flow area A for water to pass through the tapered opening and the slot and to exit the sprinkler 1 is varied. The rotation of this flow valve element 12 is preferably linked to the arc of coverage setting so that as the arc of coverage setting is changed, the flow area A through the nozzle is increased, or decreased, to provide additional or less flow so that a uniform amount of water is dispersed per unit of area by the sprinkler 1.

As a result, matched precipitation for all of the sprinklers in an irrigation zone can be provided despite the fact that they may not all be set to the same arc of coverage. Generally, in order to provide matched precipitation, the nozzle flow area of a sprinkler that is set for an arc of coverage of 180 degrees should be twice as large as that of another sprinkler whose arc of coverage is set at only 90 degrees. Otherwise, the area covered by the sprinkler with an arc of coverage of 90 degrees will be over-watered by 100% by the time the area being watered by the sprinkler set for 180 degrees receives the necessary water to replace its evaporation and transpiration water loss (ET). Using the sprinkler assembly 1 of the present application, the change in flow area is automatically made as the arc of coverage is changed.

In one embodiment, the flow area may be adjusted separately from the arc of coverage to increase or decrease the sprinkler's precipitation rate, if desired. The actual flow rate for a standard design pressure may be indicated on the sprinkler, on the top of the sprinkler, for example, along with the arc of coverage that it is set for (see FIG. 6, for example). Using the sprinkler assembly 1, for example, of the present application, the arc of coverage and the correct nozzle flow rate can be set from the top of the sprinkler while the rotor is in the retracted position and before installation for ease and speed of installation. There is no need to change or select a different nozzle for the sprinkler prior to installation or after installation as is commonly done with conventional sprinkler to adjust the flow rate to the arc of coverage. In addition, the correct arc of coverage can be confirmed after installation.

One embodiment of an oscillating nozzle sprinkler assembly 1 of the present application is discussed in further detail with reference to FIGS. 1-6. More specifically, FIG. 1 shows a cross sectional view of an oscillating sprinkler assembly 1 including an oscillating nozzle assembly, or nozzle housing, 2 in accordance with an embodiment if the present application that provides an adjustable arc of coverage and integrated flow area adjustment. In a preferred embodiment, a flow rate adjustment shaft 16 is frictionally coupled with the arc set indicating member 18 at 15. The arc set indicating member 18 is in turn gear coupled at 21 to the arc setting shaft 20 which is itself gear coupled at its lower end at 19 to a gear 22. The gear 22 is preferably coupled to an arc set concentric nozzle drive shaft 21. This concentric shaft 21 is connected to the arc of oscillation contact member in the sprinkler riser 3 which causes the nozzle assembly 2 to rotate in first one direction and then the other through the set arc of coverage whether utilizing a reversing turbine, ball drive or gear cage type of reversing mechanism.

Figure 4:
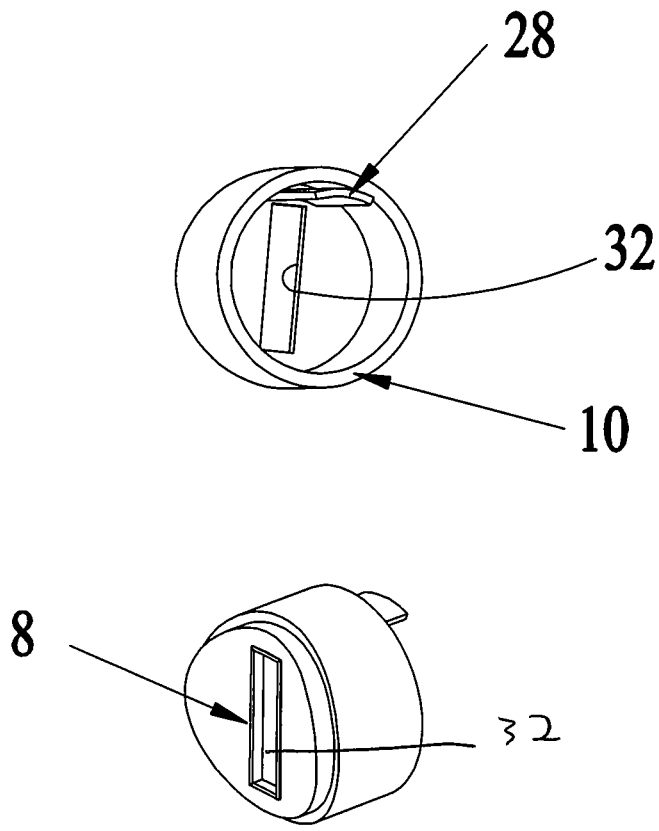
FIG. 4 shows a perspective view of a removable nozzle for use in the sprinkler assembly of FIG. 1.

The flow rate adjustment shaft 16 is gear coupled via the teeth 14 formed on a cone shaped flow valve element 12 such that the flow valve element rotates to increased or decreased the flow area A (see FIG. 2 for example) through the nozzle 10 as the edge 30 of an opening O formed in the wall of the flow valve element 12 is moved across the vertical slot 32 formed in the nozzle 10. The valving action between the nozzle 10 and the valve 12 allows for adjustment of the area A through which water flows through the valve opening O and the slot 32 in the nozzle 10 and out of the sprinkler assembly 1. A slightly raised valving contact surface 8 is preferably provided on the inner surface of the nozzle 10 around the slot 32 to aid in the valving action between the nozzle and the valve. This raised surface 8 is illustrated in FIG. 4, for example.

In a preferred embodiment, the flow valve element 12 includes a co-molded integral elastomeric sealing surface formed on the outside thereof. If desired, the nozzle 10 may be molded of a hard elastomeric material to enhance the sealing between rotationally moving parts of the valve member 12 and the nozzle 10.

Figure 3:
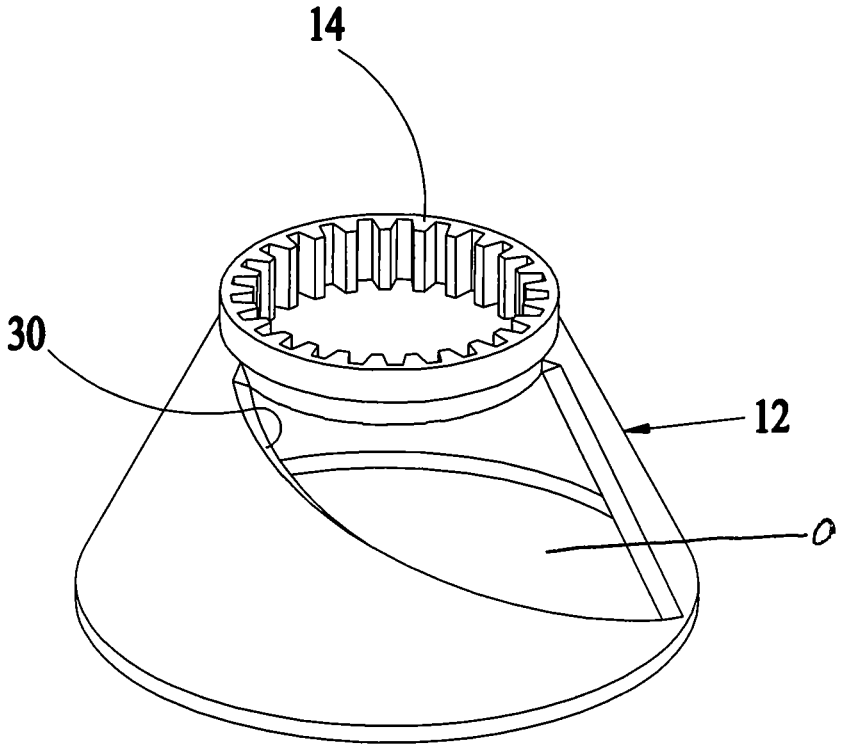
FIG. 3 shows a perspective view of a cone shaped flow valve element of the sprinkler assembly of FIG. 1

As can be seen in more detail in FIG. 3, the flow valve member 12 is preferably cone shaped with its conical wall inclined at an angle of approximately 25 degrees. The opening O is tapered such that as the element 12 rotates, a larger portion of the opening O is aligned with the slot 32 in the nozzle 10, thus changing the size of the flow area A.

While the valve member 12 is preferably rotated based on changes in the arc of coverage, the valve member 12 may be manually rotated by manipulation of the shaft 16. In this manner, a precipitation rate provided by the sprinkler 1 can be changed without changing the arc of coverage. Preferably, the connection between shaft 16 and shaft 18 is somewhat weaker than that between the shaft 18 and the arc setting shaft 20. Thus, the shaft 16 can be rotated to adjust the flow area A without rotating the shaft 18 and changing the arc of coverage, if desired.

The range of coverage provided by the stream of water may be adjusted based on a stream angle elevation adjustment screw 29 or an upstream throttling and shut-off valve 40 which may be included to allow for easy shut off of the sprinkler 1, or reduction in the range of coverage up to 25% with a minor increase in the precipitation rate for the smaller area of coverage at the shorter range.

More specifically, the stream exit angle from the flow area A through the nozzle 10 is preferably adjustable by turning the stream exit angle adjustment screw 29 downwardly to bend the stream deflector beam 28 downwardly. The underside 25 of the stream deflection beam is preferably concave in shape to tend to hold the stream together. The screw 29 also retains the nozzle member 10 in the nozzle assembly 2 as shown at 11. The adjustment screw 29 may also be used as a stream break-up and retention screw, if desired, provide that the stream deflector beam 28 is removed.

An upstream flow throttling and shut-off valve 40 may also be provided as is shown in FIG. 1, for example, with its seat seal 41. It is preferably operable via a gear connected shaft 45 (See FIG. 5) that extends to the top of the nozzle assembly 2 (see FIG. 5 and FIG. 6, for example). A cooperating rack gear 46 is provided on the valve 40. The flow opening B in the shut-off valve 40 is aligned with the flow opening C of the nozzle drive shaft 24 (see FIG. 1) in an open position. The opening B is movable by the rack 46 and gear on the bottom of shaft 45 to a partially closed position to provide upstream flow throttling and sprinkler range of coverage control and to a closed position to shut off the sprinkler assembly 1 entirely. The throttling valve 40, as shown, is a roughly triangular in shape and rotates based on the interaction of the gear on the bottom of shaft 45 with the teeth of the rack gear 46 to move the opening B into and out of alignment with the flow opening C of the drive shaft 24.

Figure 6:
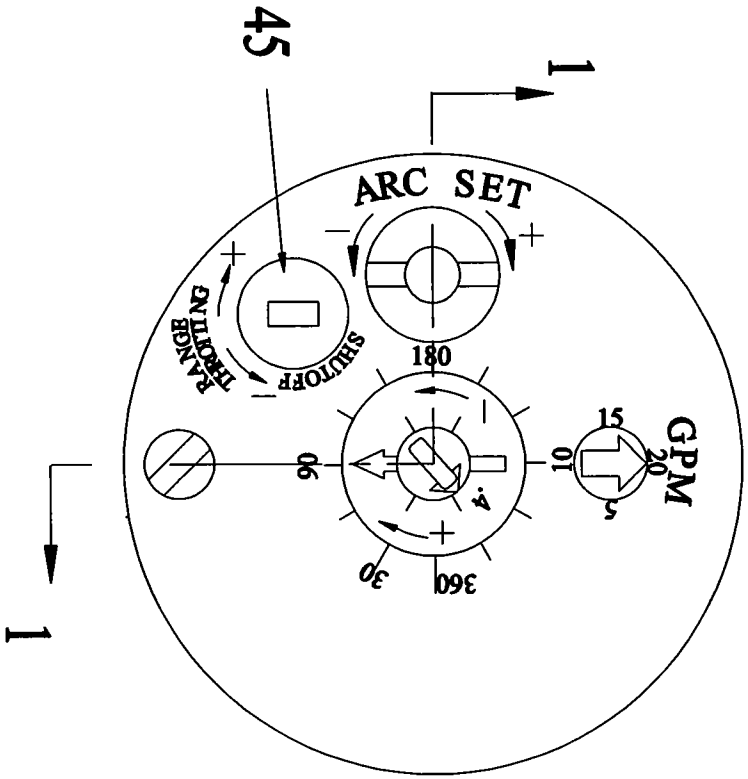
FIG. 6 shows a top view of the nozzle housing of the sprinkler assembly of FIG. 1.

As can be seen in FIG. 6, in a preferred embodiment, the arc of coverage that is set, the flow rate and the throttling condition are all indicated at the top of the assembly 1 so that they can be easily viewed by a user. Further, all of these parameters are adjustable from the top of the assembly as well.

Figure 7:
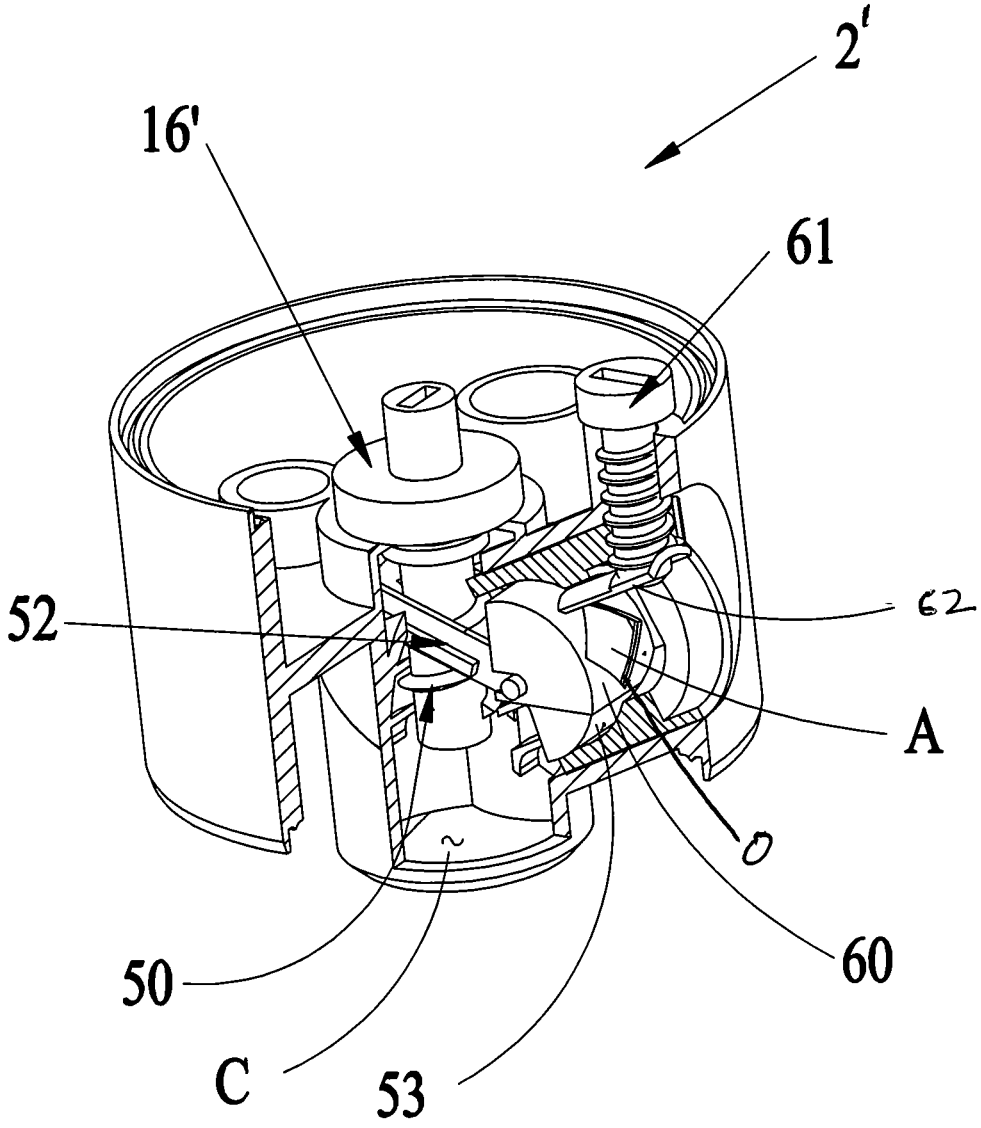
FIG. 7 shows a perspective view of an oscillating nozzle assembly for use with an oscillating nozzle sprinkler with adjustable arc of oscillation and an adjustable nozzle exit flow area in accordance with another embodiment of the present application.

FIG. 7 shows a perspective view of a different configuration an oscillating nozzle assembly $\mathbf{2}^1$ in accordance with another embodiment of the present application. In this embodiment stream exit angle and nozzle flow area adjustment are integrated. The flow adjustment shaft $\mathbf{16}^1$ is rotated with the arc of coverage adjustment indicator shaft 18 as discussed above with reference to FIG. 1, however, the lower end of the flow control shaft $\mathbf{16}^1$ has a spiral surface thread 50 which moves a actuator arm 52 up and down to rotate a nozzle valving opening O in the nozzle element 53 between an opened and closed position against a mating valve piece 60. The thread 50 may have a variable pitch to provide a uniformly increasing nozzle flow area as with arc of coverage setting shaft is rotated. Thus, as the arc of coverage is changed, the shaft $\mathbf{16}^1$ rotates and moves the actuator arm 52 to move the opening O into and out of alignment with an opening in the mating piece 60 to adjust the flow area A.

Figure 8:
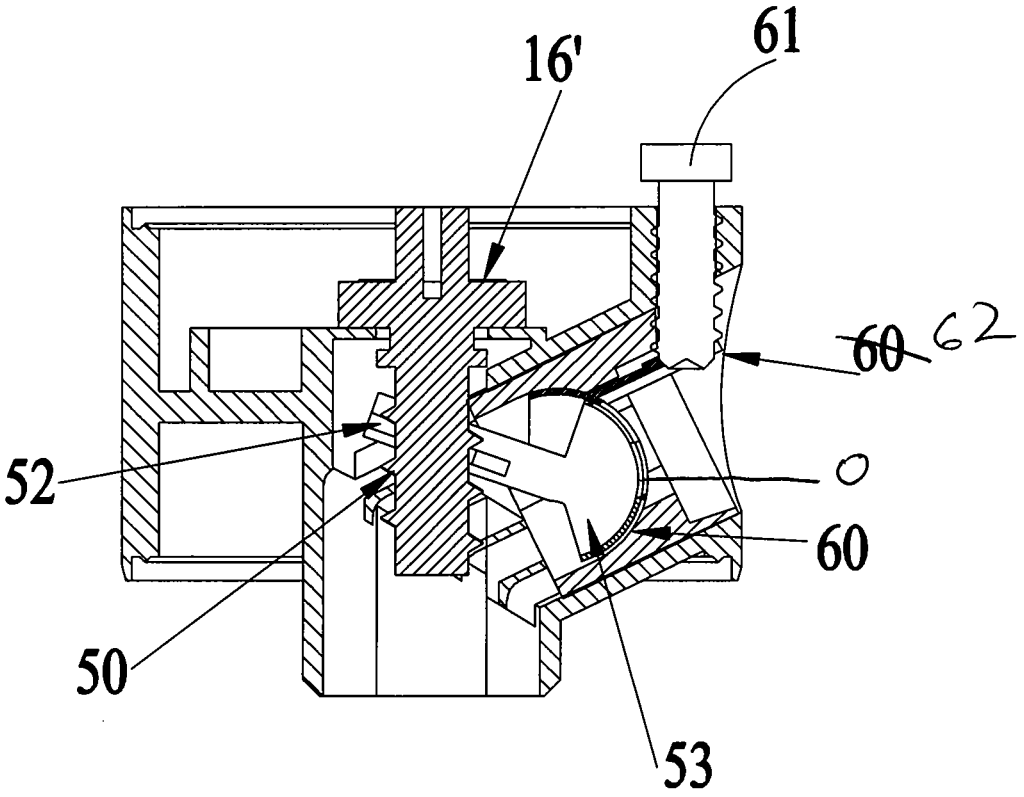
FIG. 8 shows a cross-sectional view of the assembly of FIG. 7.

In this configuration, the mating valve piece 60 is also rotatable via arm 62 which may be moved by stream elevation adjustment screw 61. Thus, the open flow area A is also directly increased or decreased as the stream exit angle is changed to help compensate for the increased or decreased area of coverage of the sprinkler resulting from the change in range of coverage. That is, as the range of coverage is increased or decreased, depending on the exit stream angle adjustment, the flow area A is increased or decrease to maintain the precipitation rate. FIG. 8 illustrates a cross-sectional view of the assembly $\mathbf{2}^1$ illustrated in FIG. 7.

Figure 9:
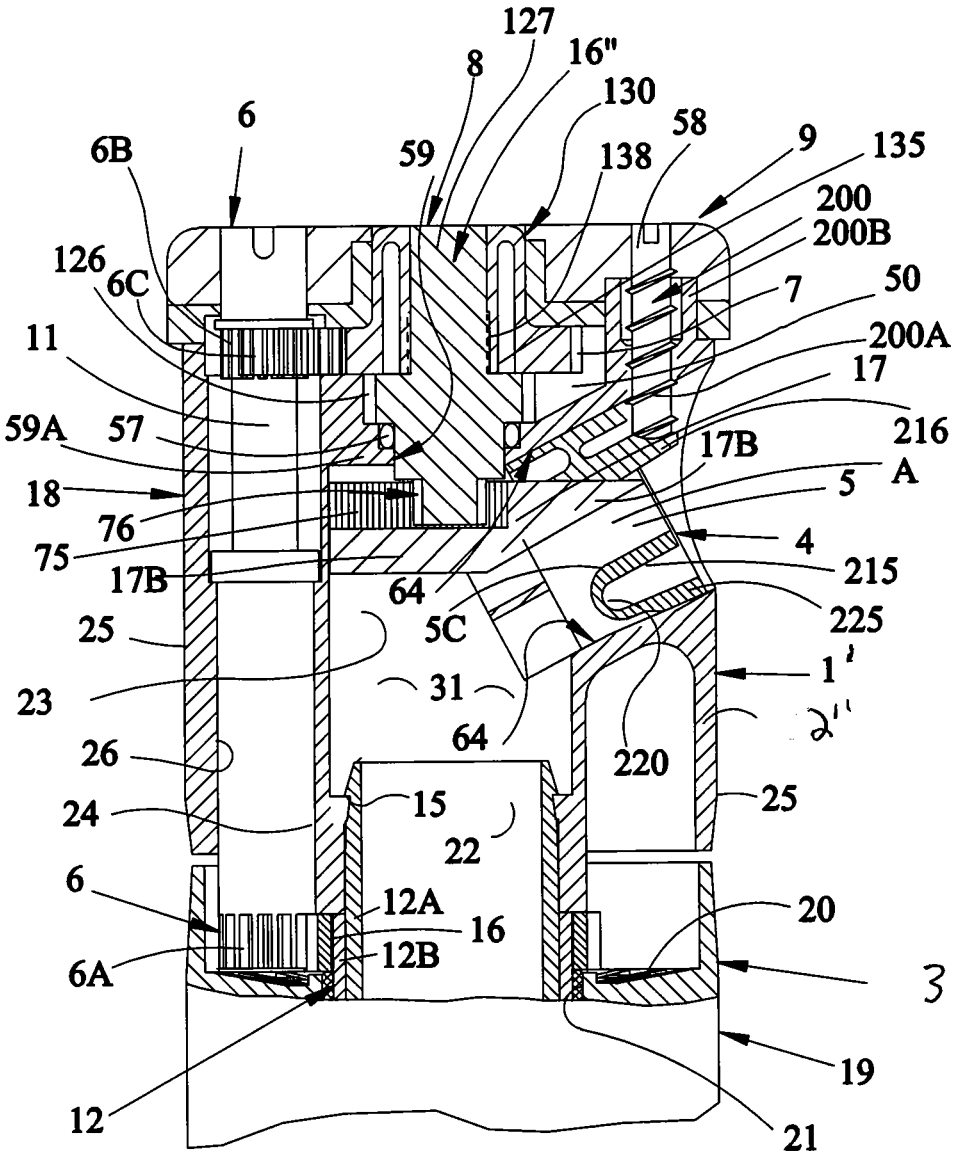
FIG. 9 shows a cross-sectional view of an oscillating nozzle sprinkler assembly with adjustable arc of oscillation and an adjustable nozzle exit flow area in accordance with another embodiment of the present application.

FIG. 9 shows a cross-sectional view of another embodiment of an oscillating nozzle sprinkler $\mathbf{1}^1$ including a nozzle housing, or nozzle assembly $\mathbf{2}^{11}$ including a nozzle flow throttling plug 17B that is movable in and out of the nozzle flow area A by a gear 76 on a lower end of the flow control shaft $\mathbf{16}^{11}$ which drives a rack 75 mounted on the nozzle throttling plug member 17B to move the plug laterally (left and right in FIG. 9) with respect to a longitudinal axis of the sprinkler $\mathbf{1}^1$. In this embodiment, the plug 17B is movable based on rotation of the flow control shaft $\mathbf{16}^{11}$. As the plug 17B moves to the right in FIG. 9, the wedge shape of the plug will compress the nozzle opening 5, and thus, reduce the flow area A through the nozzle. The arc setting device 6 includes the arc setting shaft 11 and is rotated to set a desired arc of coverage in a manner similar to that describe above with respect to FIG. 1. The gear 6B of the shaft 11 engages a complimentary gear 7 on shaft 130 through intermediate gear 6C. The flow control shaft $\mathbf{16}^{11}$ includes serrations 138 that are used to link the shaft 130 to the shaft $\mathbf{16}^{11}$. Thus, the flow control shaft $\mathbf{16}^{11}$ will rotate with the arc setting shaft 11. The oscillating nozzle sprinkler assembly $\mathbf{1}^{11}$ of FIG. 9 is similar to that described in U.S. Pat. No. 6,932,952, which is hereby incorporated by reference herein, and thus, is not specifically discussed further herein.

As was noted briefly above, it is common to adjust range of coverage by providing nozzles, such as nozzle 10, with different slot sizes. Indeed, nozzles are often color coded with each color representing a specific slot width, and therefore, a specified range. For example, blue may represent a thin slot width suitable, for example, to provide sufficient flow for a range of 15-18 feet, and suitable to provide the proper flow adjustment for all arc of coverage settings for coverage to this distance. If the range is to be changed, a new nozzle may be inserted. In this case, the throttling and shut-off valve 40 described above would be useful to allow for the changing of such a nozzle when desired.

It is also noted that oscillating sprinklers such as the oscillating nozzle sprinkler assembly 1 of FIG. 1, for example can be a direct, low precipitation rate replacements for fixed spray head sprinklers while providing much higher efficiency. The scheduling coefficient of most spray head sprinklers is typically 1.7 or higher, that is, the irrigation system will have to run approximately 70% longer than theoretically calculated in order to ensure that the driest area of an irrigation zone reaches the proper average precipitation. In contrast, oscillating sprinklers provide much higher efficiency as a low precipitation rate replacement when they have the correct nozzle flow rate for the arc of coverage that they are used for.

Gear driven or oscillating nozzle sprinklers can easily operate reliably at as low as 0.5 GPM and provide scheduling coefficients of 1.1 to 1.2. As a result, replacing fixed spray head sprinklers with gear driven sprinklers provides water savings due to increased efficiency of 30% to 50%. Further, lower water flow rate requirements are necessary as well. For example, fixed spray sprinklers typically utilize a flow rate of 1.6 GPM for 180° coverage and over 3 GPM for full circle coverage in contrast with the mere 0.5 GPM rate required in oscillating sprinklers. Thus, the flexibility provided by providing automatic adjustment of flow rates with arc of coverage allows the oscillating nozzle sprinkler assembly 1, for example, of the present application to completely replace inefficient fixed sprinklers.

As noted above, nozzle slot widths may be selected and color-coded to provide the correct range of coverage at a desired precipitation rate. For example, a nozzle, such as nozzle with the proper slot width for flow rates for a 25 foot range and the desired precipitation rate could be provided I.e. color coded green, for 40 feet and greater color coded red, so that a quick look could tell what range of coverage the sprinklers were manufactured to cover with only the changing of one part and then they automatically set their correct flow rate for their arc of coverage set for each sprinkler.

While having a nozzle design specific for a range of coverage provides the most efficient spray patterns, a 10-25% range reduction can be made simply using the upstream throttling shut-off valve 40 described above. Use of the valve 40 to modify the range is more efficient than simply using the screw 29 as a stream break-up screw as is done in existing sprinklers of this type now on the market, which provides no flow reduction as the range is decreased using just stream break-up, for example, as describe above to modify the exit angle, and thus, the range of the output stream.

Nonetheless, In accordance with an embodiment of the present application, the nozzle 10 may be color-coded based on the width of the slot formed therein. As is discussed above, adjusting slot width may be used to change the range of coverage of the output water stream. Specifically, the slot width affects exit angle characteristics of the stream of water that flows through the valve 12 and the slot formed in the nozzle 10 out of the sprinkler assembly. The nozzle 10 is preferably removable and color-coded to reflect the slot width thereof. Utilizing different nozzles 10, which are appropriate for selected ranges, allows for oscillating sprinklers to easily replace fixed spray sprinklers to improve efficiency. Nozzles 10 with the proper slot width to provide the correct flow rate and precipitation rate (matched precipitation) may be selected. Wider slot widths may be used to provide matching precipitation rates for ranges of 40 feet or more. However, the use of exactly the correct nozzle slot width is unnecessary in using the oscillating nozzle assembly 2 of the present application as is noted above.

Figure 5:
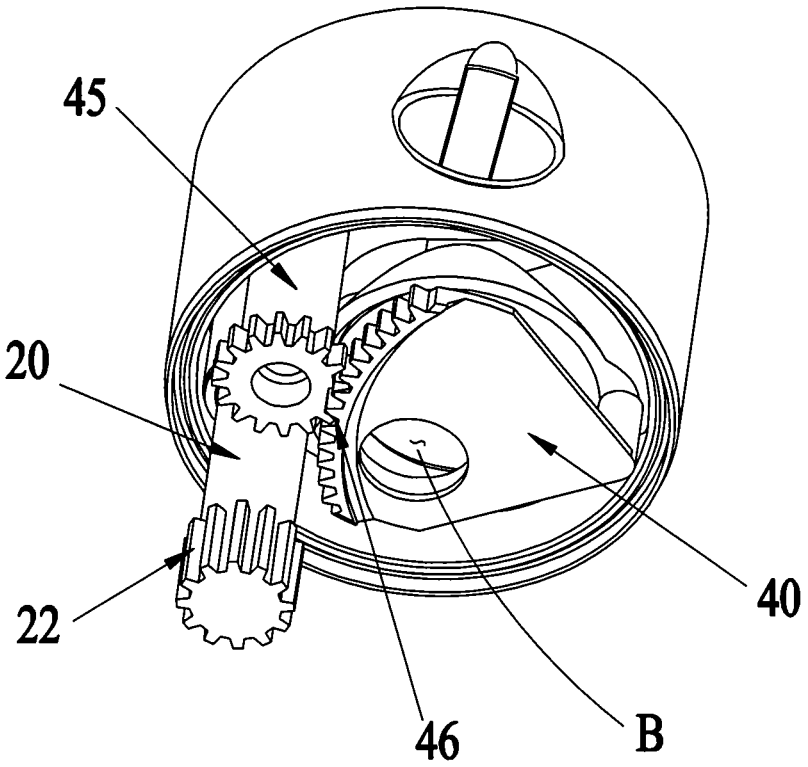
FIG. 5 shows a perspective view of an upstream throttling and shutoff valve of the sprinkler assembly of FIG. 1.

The upstream flow throttling and shut-off valve 40 as shown in FIG. 1 and FIG. 5 can be incorporated into the automatic flow adjusting with arc set sprinkler assemblies shown in FIGS. 7, 8 and 9 to throttle or shut off the flow into the nozzle housing through area C or 31.

Accordingly, the oscillating nozzle assembly 2 of the oscillating nozzle sprinkler assembly 1 of the present application provides for automatic flow adjustment as the arc of coverage is adjusted. In particular a tapered opening is formed in cone shaped valve element such that the flow opening is increased or decreased as the cone valve element is rotated to provide matched precipitation despite arc of coverage. A flow throttling or shut off valve 40 may be provided to modify stream range and to allow for shut off of the sprinkler as well. This provides even more flexibility.

Nozzle configurations have been shown using interacting cylindrical surfaces, one of which preferably having a co-molded rubber (or elastomeric) surface for achieving sealing between the relative rotational movement between the parts to achieve an adjustable nozzle exit area, or flow area. The relative rotatable parts have been shown rotating both about a vertical axis (in FIG. 1) and a horizontal axis (FIG. 7). Also, while not shown, a second matching cone with a vertical side may be incorporated to allow adjustment on one side of the vertical slot to provide an adjustable slot width as well as adjustable slot height without externally changing parts.

Although the present invention has been described in relation to particular embodiments thereof, many other variations and modifications and other uses will become apparent to those skilled in the art.

What is claimed is:

1. An oscillating sprinkler with adjustable arc of coverage comprising:

a nozzle;

a nozzle drive mechanism operable to drive the nozzle through a set arc of coverage;

an arc set mechanism coupled to the nozzle drive mechanism and operable to adjust the set arc of coverage for the nozzle drive mechanism; and a flow control mechanism formed as part of the nozzle and configured and operable to vary a nozzle flow area through which water flows through the nozzle and out of the sprinkler, the flow control mechanism coupled to the arc set mechanism such that the flow area is adjusted with the arc of coverage, the flow control mechanism further comprising:

a flow valve element rotatably mounted as a part of the nozzle and configured such that the flow valve element itself increases the flow area when rotated in a first direction and decreases the flow area when rotated in a second direction opposite the first direction.

2. The oscillating sprinkler of claim 1, wherein the flow control mechanism is coupled to the arc set mechanism such that the flow area is manually adjustable without adjustment of the arc of coverage.

3. The oscillating sprinkler of claim 2, further comprising:

a spray range setting mechanism operable to adjust a range of the stream of water exiting the sprinkler.

4. The oscillating sprinkler of claim 3, wherein the spray range setting mechanism further comprises:

an adjustable range setting actuator mechanism coupled to a deflectable portion of the nozzle, the deflectable portion of the nozzle being constructed to set an exit angle of the stream flowing from the nozzle according to the adjustment of the actuator mechanism.

5. The oscillating sprinkler of claim 4 wherein the actuator mechanism is a rotatable threaded shaft which moves linearly to pivot the deflectable portion of the nozzle.

6. The oscillating sprinkler of claim 1, wherein the flow valve element is cone shaped and includes a tapered opening formed in a conical wall thereof such that rotation of the flow valve element in the first direction aligns a large portion of the tapered opening with an opening in the nozzle and rotation of the flow valve element in the second direction aligns a smaller portion of the tapered opening with the opening in the valve.

7. The oscillating sprinkler of claim 1, further comprising a throttling valve positioned upstream from the flow control mechanism and operable to rotate from an open position in which water flow to the nozzle is uninterrupted and a closed position in which water flow to the nozzle is stopped.

8. The oscillating sprinkler of claim 7, wherein the throttling valve is rotatably mounted and includes an opening formed therein that is aligned with a flow path through the oscillating sprinkler when the throttling valve is in the open position to allow uninterrupted flow of water to the nozzle and is out of alignment with the flow path in the closed position.

9. The oscillating sprinkler of claim 8, wherein the throttling valve is operable to be positioned between the open position and the closed position such that the opening is partially aligned with the flow path and the flow of water to the nozzle is reduced such that a range of the water stream from the oscillating sprinkler is reduced.

10. The oscillating sprinkler of claim 1, wherein the flow control mechanism further comprises:

an actuator movable up and down to control the flow area; and the flow valve element is pivotably coupled to the actuator and including a flow opening that moves relative to a mating element of the nozzle as the actuator is moved such that the flow area depends on alignment of the flow opening with a second opening of the mating element.

11. The oscillating sprinkler of claim 10, further comprising:

a spray range setting mechanism operable to adjust a range of the stream of water exiting the sprinkler.

12. The oscillating sprinkler of claim 11, wherein the spray range setting mechanism further comprises:

an adjustable range setting actuator mechanism coupled to a deflectable portion of the nozzle, the deflectable portion of the nozzle being constructed to set an exit angle of stream flowing from the nozzle according to the adjustment of the actuator mechanism; and wherein the adjustable range setting actuator mechanism is also coupled to the mating element such that mating element moves with the adjustable range setting actuator mechanism and the flow area is adjusted based on adjustment of the spray range.

13. The oscillating sprinkler of claim 1, wherein the flow control mechanism further comprises:

an actuator rotatable around, and extending parallel to, a longitudinal axis of the oscillating sprinkler; and a plug element coupled to the actuator to move laterally with respect to the longitudinal axis of the oscillating sprinkler based on rotation of the actuator, wherein the plug element moves toward the nozzle and compresses the nozzle to reduce the flow area through an opening in the nozzle when the actuator is rotated in a first direction.

14. The oscillating sprinkler of claim 1, further comprising an actuator coupled to the arc set mechanism such that the flow area varies based on the arc of coverage.

15. The oscillating sprinkler of claim 14, wherein the actuator is coupled to the plug element utilizing a rack and pinion connection.

16. An oscillating sprinkler with adjustable arc of coverage comprising:

a nozzle;

a nozzle drive mechanism operable to drive the nozzle through a set arc of coverage;

an arc set mechanism coupled to the nozzle drive mechanism and operable to adjust the set arc of coverage for the nozzle drive mechanism; and a flow control mechanism formed as part of the nozzle and configured and operable to vary a nozzle flow area through which water flows through the nozzle and out of the sprinkler, the flow control mechanism coupled to the arc set mechanism such that the flow area is adjusted with the arc of coverage, wherein the nozzle is selected based on a size of an opening in the nozzle through which water passes to exit the sprinkler, the flow control mechanism further comprising:

a flow valve element rotatably mounted as a part of the nozzle and configured such that the flow valve element itself increases the flow area when rotated in a first direction and decreases the flow area when rotated in a second direction opposite the first direction.

* * * * *